US006185967B1

(12) United States Patent
Imanari et al.

(10) Patent No.: US 6,185,967 B1
(45) Date of Patent: Feb. 13, 2001

(54) STRIP THREADING SPEED CONTROLLING APPARATUS FOR TANDEM ROLLING MILL

(75) Inventors: Hiroyuki Imanari, Chiba; Masashi Tsugeno, Mitaka, both of (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/395,183

(22) Filed: Sep. 14, 1999

(30) Foreign Application Priority Data

Sep. 14, 1998 (JP) ..... 10-259548

(51) Int. Cl.[7] ..... B21B 37/48
(52) U.S. Cl. ..... 72/8.6; 72/10.3; 72/11.4
(58) Field of Search ..... 72/7.2, 7.4, 8.6, 72/11.4, 12.3, 205, 234, 10.3, 9.2, 11.8; 226/91

(56) References Cited

U.S. PATENT DOCUMENTS 4,998,427 * 3/1991 Peterson et al. ..... 72/205
5,012,660 * 5/1991 Peterson et al. ..... 72/205
5,103,662 * 4/1992 Fapiano ..... 72/205
5,235,834 * 8/1993 Bolkey et al. ..... 72/234
5,546,779 * 8/1996 Ginzburg ..... 72/234

FOREIGN PATENT DOCUMENTS 7-164027 6/1995 (JP) .

* cited by examiner

*Primary Examiner*—Ed Tolan
(74) *Attorney, Agent, or Firm*—Oblon, Spivak, McClelland, Maier & Neustadt, P.C.

(57) ABSTRACT

A strip threading speed controlling apparatus for a tandem rolling mill is constructed to calculate a speed set value of two adjacent rolling stands by using a forward slip predicted considering a back tension without considering a front tension in an upstream-side rolling stand thereof, and a forward slip predicted without considering the tension in a downstream-side rolling stand, and to calculate the speed set value of each rolling stand by shifting the rolling stands stage by stage.

8 Claims, 4 Drawing Sheets

| STEEL GRADE k | WIDTH DIVISION 1 | WIDTH DIVISION 2 | ... | WIDTH DIVISION n |
|---|---|---|---|---|
| STRIP THICKNESS DIVISION 1 | | | | |
| STRIP THICKNESS DIVISION 2 | TENSION VALUE T | | | |

| STEEL GRADE k | WIDTH DIVISION 1 | WIDTH DIVISION 2 | ... | WIDTH DIVISION n |
|---|---|---|---|---|
| STRIP THICKNESS DIVISION 1 | | | | |
| STRIP THICKNESS DIVISION 2 | TENSION VALUE T | | | |

| STEEL GRADE k | WIDTH DIVISION 1 | WIDTH DIVISION 2 | ... | WIDTH DIVISION n |
|---|---|---|---|---|
| STRIP THICKNESS DIVISION 1 | | | | |
| STRIP THICKNESS DIVISION 2 | TENSION VALUE T | | | |
| ... | | | | |
| | | | | |
| STRIP THICKNESS DIVISION m | | | | |

FIG.2

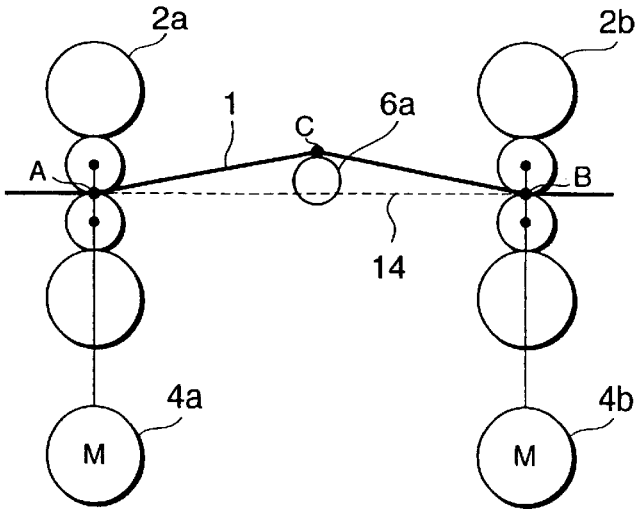

FIG.3

STRIP THREADING SPEED CONTROLLING APPARATUS FOR TANDEM ROLLING MILL

BACKGROUND OF THE INVENTION

1. Field of the Invention

The present invention relates to a strip threading speed controlling apparatus for a tandem rolling mill.

2. Related Background Art

In a hot tandem rolling mill, a target value of roll gaps and a rolling mill speed target value are calculated in consideration of characteristics of materials and rolling conditions as well in order to attain a desired strip thickness, a desired strip width and a desired rolled material temperature, and are set as initial values. These processes are executed by a set up calculation function.

An outline of the conventional set up calculation function in the tandem rolling mill will be explained referring to FIG. 4. A rolled material 1 is fed sequentially through a series of rolling stands 2*a*, 2*b*, 2*c*, - - - , 2*n* disposed in tandem, and is subjected to a rolling process. The rolling stands 2*a* 2*n* are provided with roll gap adjusters 3*a*, 3*b*, 3*c*, 3*n*. Work rolls of the rolling stands 2*a*–2*n* are rotationally driven by electric motors 4*a*, 4*b*, 4*c*, - - - , 4*n*, respectively. Speeds of the electric motors 4*a*–4*n* are controlled by speed controllers (ASR) 5*a*, 5*b*, 5*c*, - - - , 5*n* so as to attain a predetermined speed of the rolling mill. Each of loopers 6*a*, 6*b*, 6*c*, - - - , 6*m* for controlling an interstand rolled material tension is provided between the two adjacent rolling stands. The loopers 6*a*, 6*b*, 6*c*, - - - , 6*m* are provided with tension meters 7*a*, 7*b*, - - - , 7*m*, respectively, for measuring a tension of the rolled material 1. A setup calculation device 9 gives a speed command via a set up execution device 8 to the speed controllers 5*a*–5*n*. The set up calculation device 9 calculates a roll speed target value and a roll gap target value for each rolling stand in accordance with a rolling condition and target values of a thickness and a width of the rolled material, which are given each time. The roll speed target value is given as a speed command to the controllers 5*a*–5*n* via the set up execution device 8. The roll gap target value is given to the roll gap adjusters 3*a*–3*n* similarly via the set up execution device 8 and an unillustrated signal route.

A procedure of the set up calculation made by the set up calculation device 9 will be explained referring to FIG. 5. Generally in the hot rolling, to start with, a roll speed of the rolling stand serving as a pivot (reference) is calculated in order to set a temperature of the rolled material on an delivery side of the last rolling stand to a desired value (block 502). In general, the last rolling stand is set as the pivot stand. On the other hand, with a start of the set up calculation, a predictive calculation of a rolling force is performed, and a predictive value thereof is allocated to each rolling stand (block 504). Further, a strip thickness on the delivery side of each rolling stand is calculated (block 506), and thereafter a forward slip is calculated (block 508). With reference to results of those calculations, a speed of each rolling stand is calculated so that a mass flow (=width*thickness*speed=material moving quantity per unit time) of each rolling stand becomes constant (block 510). The speed, the forward slip, the delivery-side strip thickness and the rolling force necessary for the set up calculation influence on each other, and hence a convergence calculation might be performed in some cases as the necessity may arise in the block 503 which is indicated by the dotted line and embraces the blocks 504–510. After calculating the speed of each rolling stand, the roll gap of each rolling stand is calculated (block 512), and the set up calculation comes to an end.

In the thus executed set up calculation, there might occur an error because of implementing the predictive calculation based on a model etc. Automatic Gage Control, Looper Control for tension control, and control of temperature of the rolled material by water cooling, are carried out for eliminating the above error and further an influence of disturbance after starting the rolling process.

It is presumed in the set up calculation described above that front and back tensions at each rolling stand become a steady state as the target values indicate. In this case, there is induced such a state that a mass flow in the rolling stands disposed upstream is smaller than a mass flow in the rolling stands disposed downstream. As a result, the tension between the rolling stands might increase in the great majority of cases. The reason for this is elucidated as follows.

It is a general notion that the forward slip is largely influenced by a draft as well as being influenced by the front and back tensions. Based on the generality, the forward slip can be modeled by the formula (1):

$$f_{i-f}{}^{0}{}_{i}+\alpha_{fi}(t_{fi}/K_{mi})-\beta_{fi}(t_{bi}/K_{mi}) \ldots \quad (1)$$

however, $f^{0}{}_{i}=\alpha_{fi}r_{i}^{bfi}$, and $r_i=1-h_i/H_i$ where i is the rolling stand number, $f_i$ is the forward slip, $t_{fi}$ is the front tension, $t_{bi}$ is the back tension, $K_{mi}$ is the rolled material deformation resistance, $r_i$ is the reduction, $h_i$ is the delivery-side strip thickness, $H_i$ is the entry-side strip thickness, $\alpha_{fi}$, $\beta_{fi}$, $a_{fi}$, $b_{fi}$ are the positive coefficients.

The stand speed $V_{Ri-1}$ is calculated based on the following formula (2) by use of the forward slip $f_i$ because of the mass flow being constant.

$$h_{i-1}V_{Ri-1}1+f_{i-1})=h_iV_{Ri}(1+f_i) \ldots \quad (2)$$

Namely, the delivery-side strip thickness $h_i$ at each rolling stand is determined, and, if the speed $V_{Ri}$ at the reference rolling stand (the pivot stand) is determined, it follows that the speed $V_{Ri-1}$ at the (i−1)− th stand adjacent upstream is determined. Note that generally a speed for setting the temperature of the rolled material on the delivery side of the last stand as the target value indicates, is selected as a speed at the pivot stand.

As shown in FIG. 6, with an emphasis on the rolling stand 2*b*, e.g., after the rolled material 1 comes out of the rolling stand 2*b* and before being bitten in by the next rolling stand 2*c*, a rolled material tension on the delivery side of the stand 2*b*, i.e., the front tension $t_{f2}$ at the stand 2*b* is $t_{f2}=0$. The forward slip $f_2$ of the rolled material just under the stand 2*b* in this case becomes, based on the formula (1), smaller than the forward slip when the front tension acts. Therefore, a rolled material speed $V_{S1}$ between the stand 2*b* and the stand 2*c* when the front tension does not act, is smaller than a rolled material speed $V_{s2}$ between the stand 2*b* and the stand 2*c* when the front tension acts.

In such a case, however, the conventional set up calculation has hitherto involved the use of the interstand rolled material speed $V_{s2}$ when the front tension acts, and hence the rolled material speed is estimated larger than the actual speed $V_{s1}$ immediately after threading the strip. The speed of the electric motor of the stand 2*b* is set to a much smaller value. As a result, the interstand tension excessively increases after threading the strip. When the tension is too large, the strip thickness becomes excessively thin, and the strip width becomes excessively small, with the result that a high-quality rolled material is hard to obtain. Further, if the quality declines, the rolled material might be fractured due to an over-tension, resulting in hindrance against a stable operation.

SUMMARY OF THE INVENTION

Accordingly, it is a primary object of the present invention, which was devised to obviate the problems described above, to provide a strip threading speed controlling apparatus for a tandem rolling mill, for exactly predicting a forward slip from a state of tension when threading a strip and setting a strip threading speed at a high accuracy.

To accomplish the above object, according to one aspect of the present invention, a strip threading speed controlling apparatus comprises a set up calculation device for, on the occasion of calculating speed set values of adjacent rolling stands disposed upstream and downstream, calculating the speed set values for the two rolling stands by use of a forward slip predicted in consideration of a back tension without considering a front tension in the upstream-side rolling stand, and a forward slip predicted without considering the tension in the downstream-side rolling stand.

With this construction, it is feasible to set, because of predicting the forward slip by exactly considering a state of tension when threading a strip and using the forward slip for calculating the speed set value, an optimum speed with a well-balanced mass flow, and to obtain a product exhibiting a high-quality over its entire length from a leading edge of the rolled material.

In the thus constructed strip threading speed controlling apparatus, a back tension target value may be used as the back tension.

The strip threading speed controlling apparatus may further comprise a first speed compensating device for outputting a speed compensation value from an error of a forward slip which is based on a difference between the set value of the tension between the rolling stands after a strip has been threaded and the tension value used by the set up calculation device, and compensating a speed reference.

The strip threading speed controlling apparatus may further comprise a second compensating means, replaced with the first compensating device, for outputting a speed compensation value corresponding to a distance between the rolling stands when a looper angle provided between the rolling stands is coincident with a looper angle target value, and compensating a speed reference.

In the strip threading speed controlling apparatus, the speed compensation value calculated by the first compensating device may be added to the speed compensation value calculated by the second compensating device, and this added value may be used as a compensation value for the speed reference.

According to another aspect of the present invention, a strip threading speed controlling apparatus comprises a tension predicting device for sorting out and storing measured values of tensions between the rolling stands after threading a strip, and predicting a tension of the next rolled material by collating with a rolling condition of the next rolled material, a set up calculation device for calculating a speed set value by use of a forward slip predicted in consideration of an influence of a back tension predicted by the tension predicting device without considering an influence of a front tension in an upstream-side rolling stand of the two rolling stands adjacent to each other, and a forward slip predicted without considering the influence of the tension in a downstream-side rolling stand, and a set up execution device for supplying a speed controller with a speed command based on the speed set value.

BRIEF DESCRIPTION OF THE DRAWINGS

FIG. 2 is a diagram showing an example of a structure of a tension value table used in the present invention;

FIG. 3 is an explanatory diagram showing an increment in length of a material with respect to a looper angle;

DETAILED DESCRIPTION OF THE PREFERRED EMBODIMENTS

A first embodiment of the present invention will be described.

Figure 1:
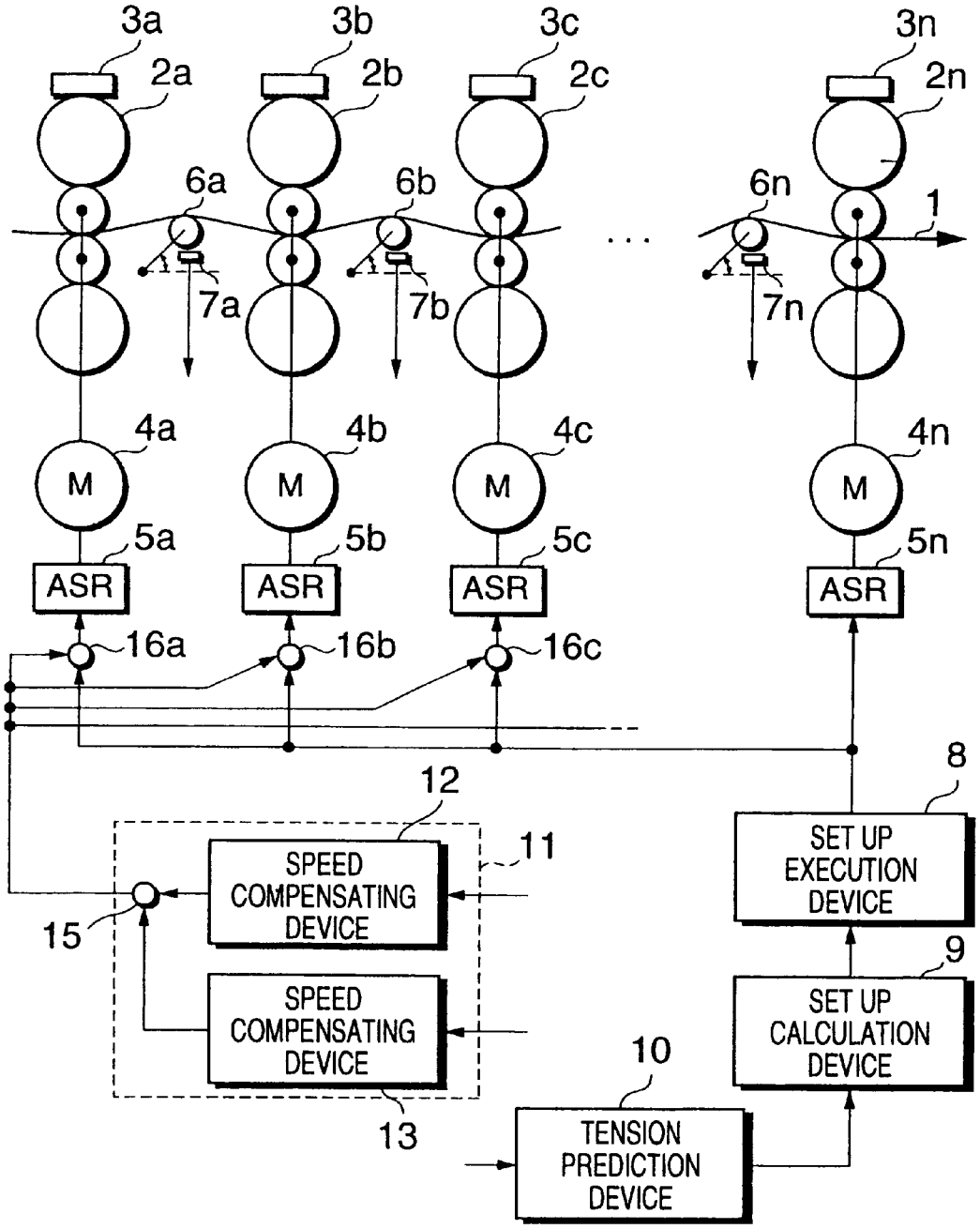
FIG. 1 is a block diagram showing a strip threading speed controlling apparatus for an embodiment of the present invention.
Figure 4:
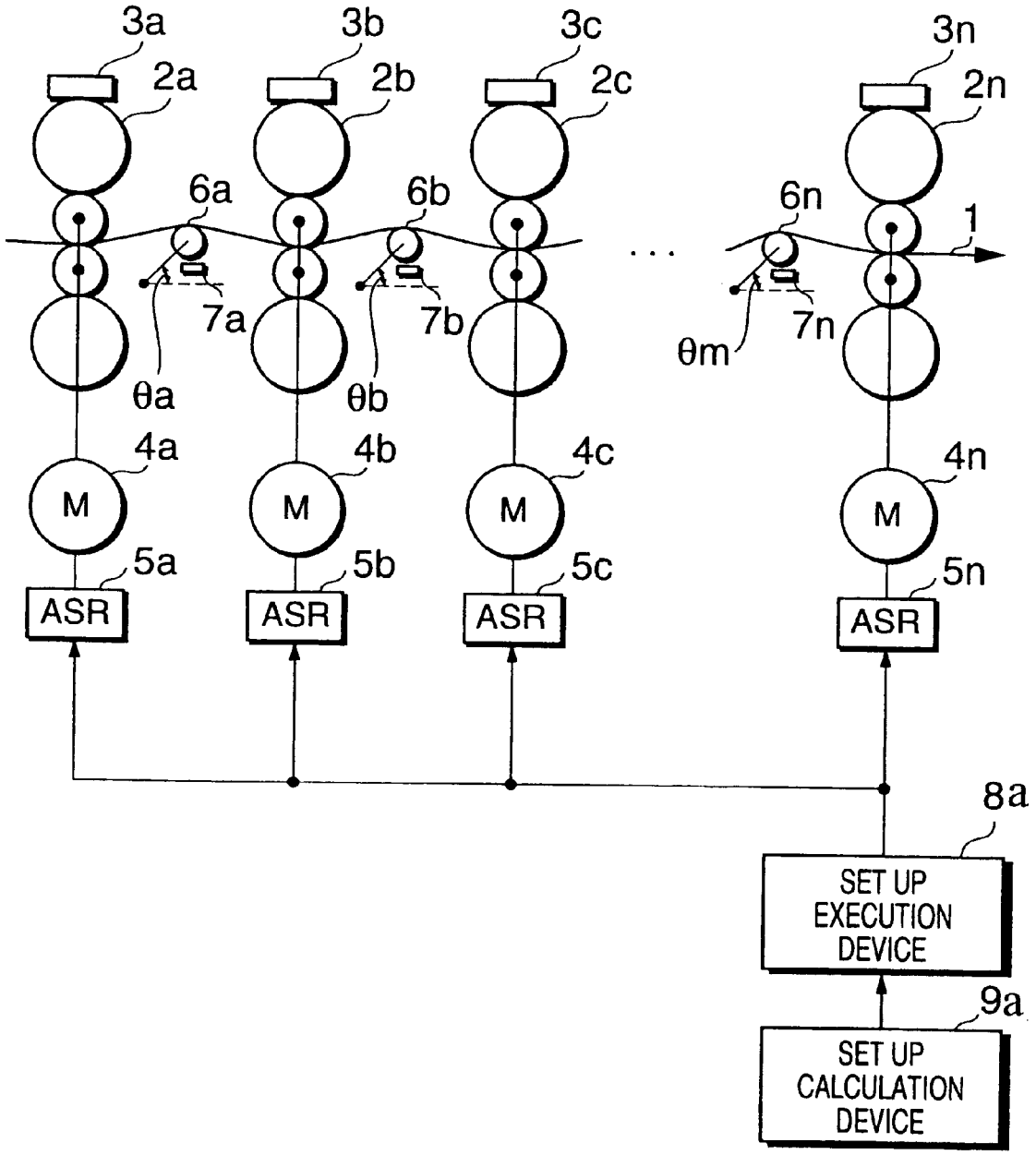
FIG.4 PRIOR ART
FIG. 4 is a block diagram illustrating a conventional strip threading speed controlling apparatus.
Figure 5:
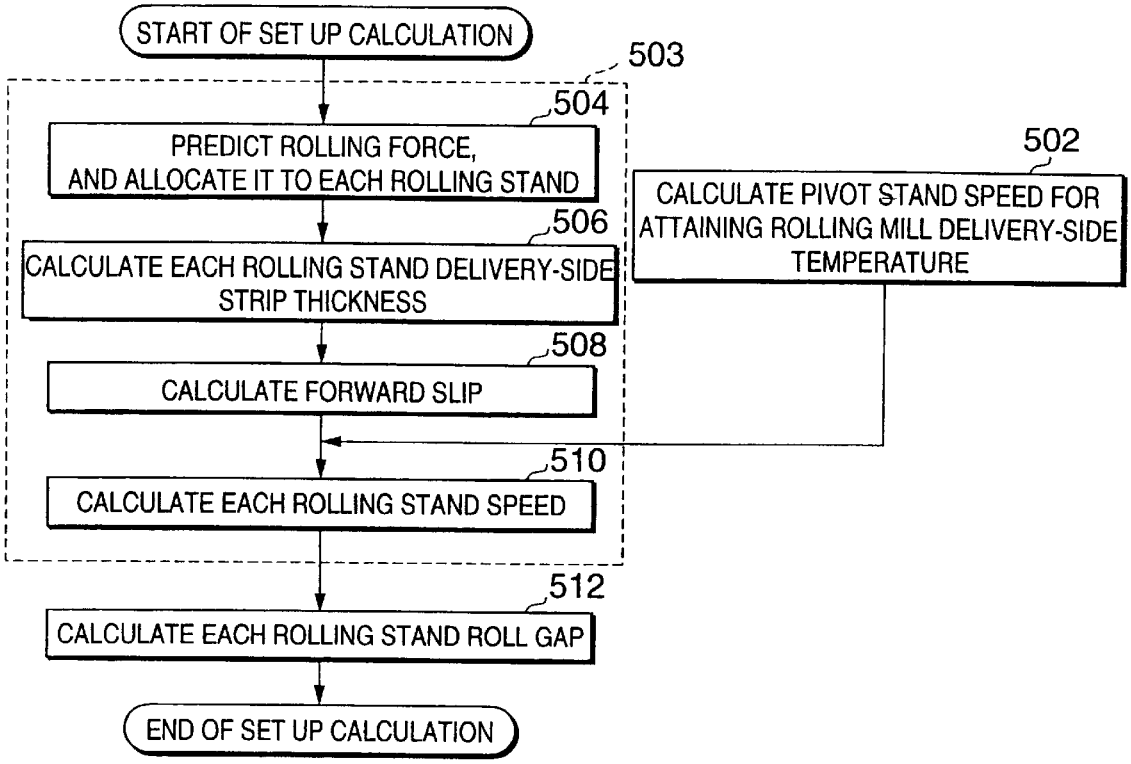
FIG.5 PRIOR ART
FIG. 5 is a flowchart showing a general processing flow of a set up calculation.

To begin with, FIG. 1 illustrates a strip threading speed controlling apparatus of the present invention, which includes a set up execution device 8*a* and a set up calculation device 9*a* incorporating functions different from those of the set up execution device 8 and the set up calculation device 9 of the prior art strip threading speed controlling apparatus shown in FIG. 4. A characteristic of the first embodiment is that the set up execution device 8 and the set up calculation device 9 shown in FIG. 4 are replaced with the set up execution device 8*a* and the set up calculation device 9*a*.

The set up calculation device 9*a* calculates a speed set value for each rolling stand in consideration of a tensile state when a strip is threaded. To be specific, the speed set value is calculated by use of a forward slip predicted considering a back tension without considering a front tension in an upstream-side rolling stand of the two rolling stands adjacent to each other, and of a forward slip predicted without considering any influence of the tension in a downstream-side rolling stand. The set up execution device 8*a* sets this speed set value and gives a speed command to speed controllers 5*a*–5*n*, and the speed controllers 5*a*–5*n* drive electric motors 4*a*–4*n*, respectively, as the speed command indicates.

Figure 6:
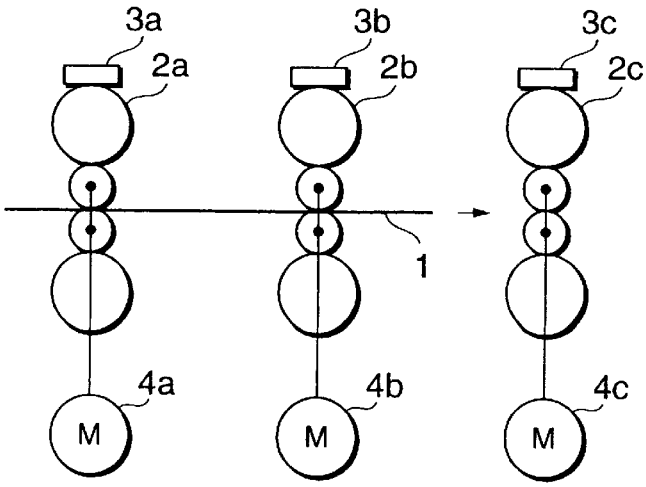
FIG. 6 is a diagram exemplifying one strip threading state of a rolled material.

Next, a method of setting the speed by use of the forward slip considering not the front tension but the back tension, will be explained referring to FIG. 6. Referring to FIG. 6, a stand 2*c* is defined as an i–th stand serving as a pivot stand, and a stand 2*b* is defined as a (i–1)–th stand. Referring again to FIG. 6, a leading edge of a rolled material 1 exists between the stands 2*b* and 2*n*, and a tension between the stands 2*b* and 2*c* is 0 (zero). Hence, a forward slip when the rolled material is bitten by the i–th stand is given in a state where both of front and back tensions are 0 (zero) in the i–th stand and in a state where only the back tension is applied in the (i–1)–th stand.

Accordingly, an equality as expressed by the following formula (3) is established:

$$h_{i-1}V_{Ri-1}(1+f^{0}{}_{i-1}\mathbf{31}\beta_{i-1}t_{bi-1}/K_{mi-1})=h_iV_{Ri}(1+f^{0}{}_{i})\ \ldots \tag{3}$$

Delivery-side strip thicknesses $h_i$, $h_{i-1}$ of the respective stands are determined by using the formula (3), and, if the speed $V_{Ri}$ of the i–th stand is given, the speed $V_{Ri-1}$ of the (i–1)–th stand can be determined.

A value of coefficient $\beta_{i-1}$ when in an actual rolling process is not obvious in many cases in the formula (3). Therefore, the value of this coefficient $\beta_{i-1}$ can be used as an adjusting parameter.

Note that a back tension target value can also be used in stead of the actually measured value thereof, wherein the value of the back tension is $t_{bi-1}$ in the formula (3).

A tension prediction device 10 for predicting a tension used in the set up calculation device 9*a* may also be provided. When threading the strip, the tension does not necessarily become a value as the target value indicates due to influences such as an error in the set up calculation and a response of looper control in some cases. In this case, the tension prediction device 10 outputs a proper tension predictive value each time corresponding to a rolling condition out of previously measured tension data stored in the form of a tension table. The tension table is created in such a way that there are measured tensions between the rolling stands immediately after threading the strip when rolled under a variety of rolling conditions such as, e.g., a thickness and a width of the rolled material, a steel grade and a temperature, and measured values of the tensions are sorted out under the above rolling conditions are arranged and stored in the form of the table.

FIG. 2 shows one example of the tension table stored with the tension measured values. This kind of table is provided in each rolling stand. The tension measured values are, though stored in the table, generally scattered per rolled material and therefore stored therein after being filtered. For instance, it is assumed that a steel grade 1, a strip thickness division 2, a strip width division 1 and a tension value T are given therein, and, as a result of being rolled, T1 as a tension value just after threading the strip is obtained. At this time, as for a value for updating the table, if the tension value before being updated is $T_{old}$, a tension value $T_{new}$ after being updated can be expressed by, e.g., the formula (4):

$$T_{new}=(1-a)T_{old}+a\times T1 \quad \ldots \quad (4)$$

Where a is the smoothing gain and takes a value from 0 to 1.

Referring to the tension table in FIG. 2, a tension value of the next rolled material can be predicted by taking out the tension value, collating with the condition of the next rolled material, and the forward slip can be predicted at a higher accuracy than in the case of using the tension target value.

The apparatus shown in FIG. 1 includes a speed compensation unit 11. The speed compensation unit 11 may include one single speed compensation device 12, or two speed compensation devices 12, 13 may be included.

Referring to FIG. 4, after the rolled material 1 has been bitten by the (i−1)− th stand 2*b*, a back tension $t_{bi-1}$ at the stand 2*b* can be measured, and hence the speed is set by use of the actually measured tension value. The speed compensation device 12 calculates a speed compensation quantity $\Delta V_{Ri-1}{}^{M}$ in the following formula (5).

Let $V_{Ri-1}{}^{0}$ be the speed compensation quantity of the (i−1)− th stand when the back tension is $t_{bi-1}$ on the basis of the formula (3), and this speed compensation quantity is given by:

$$V_{Ri-1}{}^{0}=\{(1+f^{0}{}_{i})/(1+f^{0}{}_{i-1}-\beta_{i-1}t_{b-i-1}/K_{mi-}1)\}\times(h_i/H_{i-1})\times V_{Ri} \quad \ldots \quad (5)$$

On the other hand, when the back tens ion when measured after threading the strip is $t_{bi-1}{}^{ACT}$, the speed compensation quantity $V_{Ri-1}{}^{M}$ for the (i−1)− th stand is expressed by the following formula:

$$\Delta V_{Ri-1}{}^{M}=V_{Ri-1}{}^{0}-\{(1+f^{0}{}_{i})/(1+f^{0}{}_{i-1}-\beta_{i-1}t_{b-i-1}{}^{ACT}/K_{mi-1})\}\times(h_i/H_{i-1})\times V_{Ri} \quad \ldots \quad (6)$$

This compensation quantity is added to the (i−1)-th stand, and further it is required that the speed compensation quantity be added as being successive so as to keep constant the mass flow in the upstream-side stands.

Note that the tension measured value just after the rolled material has been bitten in does not become stable as the case might be, and there is a case of requiring a process such as filtering or delaying a measurement timing.

Given next is an explanation of an embodiment in which a speed compensation device 13 is used in combination.

A looper is generally disposed on a hot rolling line. As illustrated in FIG. 3, after the rolled material 1 has been bitten in by the stand 2*b*, a looper 6*a* rises, and the rolled material is raised. As shown in FIG. 3, when presuming a distance between one pair of rolling stands 2*a*, 2*b* adjacent to each other, a distance AC+CB via a point C at which the looper 6*a* comes into contact with the rolled material 1, is longer than a rectilinear distance AB of a horizontal path line 14.

The set up calculation device 9*a*, however, as shown in FIG. 1, calculates the speed so that the mass flow in the rolling stands adjacent to each other becomes constant, and therefore an increment in the interstand length of the rolled material with respect to the looper is not taken into consideration.

This increment is compensated generally by the looper control, however, a looper angle is required to rise much earlier by assisting the looper control in order to avoid a state of an over-tension.

Such being the case, the speed compensation device 13 obtains the increment in the interstand length of the rolled material 1, i.e., a loop quantity L in the case of attaining a looper angle target value θ*, outputs a speed compensation quantity $\Delta V_L$ corresponding to the loop quantity L for a fixed time $\Delta T_L$, then obtains a second speed compensation quantity $\Delta V_2$, and thus compensates the speed set value calculated by the set up calculation device 9.

$$L=AC+CB-AB \quad \ldots \quad (7)$$

$$\Delta V_2=\Delta V_L\times\Delta T_L \quad \ldots \quad (8)$$

Note that the speed compensation device 12 and the speed compensation device 13 calculate and output the speed compensation quantity independently of each other, and, in the strip threading speed controlling apparatus having both these devices, as shown in the Figure, a sum of the respective speed compensation quantities can be used as an output compensation quantity in the speed compensation unit 11.

What is claimed is:

1. A strip threading speed controlling apparatus for a tandem rolling mill, having a series of rolling stands arranged in tandem, each including a speed controller for controlling a rotating speed of each roll, for threading a rolled material sequentially through said series of rolling stands and rolling the rolled material, said apparatus comprising:

set up calculation means for calculating speed set values of two rolling stands adjacent to each other by use of a forward slip predicted in consideration of a back tension without considering a front tension in an upstream-side rolling stand of said two rolling stands, and a forward slip predicted without considering tension in the downstream-side rolling stand, and thereafter calculating the speed set value of each of said rolling stands by shifting said rolling stands stage by stage; and set up execution means for distributing the speed set value calculated by said set up calculation means to a corresponding speed controller.

2. A strip threading speed controlling apparatus according to claim 1, wherein a value of the back tension is a back tension target value.

3. A strip threading speed controlling apparatus according to claim 1, further comprising:

first speed compensating means for outputting a speed compensation value from an error of a forward slip which is based on a difference between the set value of the tension between said rolling stands after a strip has been fed and the tension value used by said set up calculation means, and compensating a speed command.

4. A strip threading speed controlling apparatus according to claim 1, further comprising:

second compensating means for outputting a speed compensation value corresponding to a distance between said rolling stands when a looper angle provided between said rolling stands is coincident with a looper angle target value, and compensating a speed command.

5. A strip threading speed controlling apparatus according to claim 1, further comprising:

first speed compensating means for calculating a speed compensation value from an error of a forward slip which is based on a difference between the set value of the tension between said rolling stands after a strip has been threaded and the tension value used by said set up calculation means; and second compensating means for calculating a speed compensation value corresponding to a distance between said rolling stands when a looper angle provided between said rolling stands is coincident with a looper angle target value, wherein the speed compensation value calculated by said first compensating means is added to the speed compensation value calculated by said second compensating means, and the speed command is compensated based on the added value.

6. A strip threading speed controlling apparatus for a tandem rolling mill, having a series of rolling stands arranged in tandem, each including a speed controller for controlling a rotating speed of each roll, for threading a rolled material sequentially through said series of rolling stands and rolling the rolled material, said apparatus comprising:

tension predicting means for sorting out and storing measured values of tensions between said rolling stands after threading a rolled material, and predicting a tension of a next rolled material by collating with a rolling condition of the next rolled material;

set up calculation means for calculating a speed set value by use of a forward slip predicted in consideration of an influence of a back tension predicted by said tension predicting means without considering an influence of a front tension in an upstream-side rolling stand of said two rolling stands adjacent to each other, and a forward slip predicted without considering the influence of tension in the downstream-side rolling stand; and set up execution means for supplying said speed controller with a speed command based on the speed set value.

7. A strip threading speed controlling apparatus for a tandem rolling mill, having a series of rolling stands arranged in tandem, each including a speed controller for controlling a rotating speed of each roll, for threading a rolled material sequentially through said series of rolling stands and rolling the rolled material, said apparatus comprising:

a calculator configured to calculate speed set values of two rolling stands adjacent to each other by use of a forward slip predicted in consideration of a back tension without considering a front tension in an upstream-side rolling stand of said two rolling stands, and to calculate a forward slip predicted without considering tension in the downstream-side rolling stand, and thereafter to calculate the speed set value of each of said rolling stands by shifting said rolling stands stage by stage; and an execution device configured to distribute the speed set values calculated by said calculator to a corresponding speed controller.

8. A strip threading speed controlling apparatus for a tandem rolling mill, having a series of rolling stands arranged in tandem, each including a speed controller for controlling a rotating speed of each roll, for threading a rolled material sequentially through said series of rolling stands and rolling the rolled material, said apparatus comprising:

a tension predictor configured to sort out and store measured values of tensions between said rolling stands after threading a rolled material, and to predict a tension of a next rolled material by collating with a rolling condition of the next rolled material;

a calculator configured to calculate a speed set value by use of a forward slip predicted in consideration of an influence of a back tension predicted by said tension predicting means without considering an influence of a front tension in an upstream-side rolling stand of said two rolling stands adjacent to each other, and to calculate a forward slip predicted without considering the influence of tension in the downstream-side rolling stand; and an execution device configured to supply said speed controller with a speed command based on the speed set value.

* * * * *